US006420821B1

(12) United States Patent
Kishiki et al.

(10) Patent No.: US 6,420,821 B1
(45) Date of Patent: Jul. 16, 2002

(54) CATHODE FOR MAGNETRON

(75) Inventors: Kiyoshi Kishiki; Yukio Torikai; Toshihiko Yamashita; Hideyuki Obata, all of Kamifukuoka (JP)

(73) Assignee: New Japan Radio Co., LTD, Tokyo (JP)

( * ) Notice: Subject to any disclaimer, the term of this patent is extended or adjusted under 35 U.S.C. 154(b) by 0 days.

(21) Appl. No.: 09/489,339

(22) Filed: Jan. 21, 2000

(30) Foreign Application Priority Data

Feb. 10, 1999 (JP) ..... 11-032115
Oct. 28, 1999 (JP) ..... 11-306309

(51) Int. Cl.[7] ..... H01J 23/05

(52) U.S. Cl. ..... 313/326; 313/359.1; 313/351; 315/500; 315/111.81; 315/5.13

(58) Field of Search ..... 313/326, 346 R, 313/351, 359.1; 315/500, 501, 502, 503, 504, 505, 506, 111.81, 5.13

(56) References Cited

FOREIGN PATENT DOCUMENTS

| | | |
|---|---|---|
| GB | 640255 | 7/1950 |
| GB | 2 172 426 A | 9/1986 |
| GB | 2 029 632 A | 3/1989 |

*Primary Examiner*—Ashok Patel
(74) *Attorney, Agent, or Firm*—Armstrong, Westerman & Hattori

(57) ABSTRACT

A cathode for a magnetron having concave/convex portions on a surface of a cylindrical base metal with thermionic emitting materials being fixedly attached to concave portions from among the concave/convex portions. The convex portions of the concave/convex portions are arranged to be inclining. It is enabled to effectively protect thermionic emitting materials from inverse impulse of electrons or ions and from oscillation to thereby restrain consumption and omission of these thermionic emitting materials and to decrease higher harmonics of radiation.

9 Claims, 14 Drawing Sheets

CATHODE FOR MAGNETRON

BACKGROUND OF THE INVENTION

The present invention relates to a cathode for a magnetron used for microwave oscillation in a pulse radar device which is mounted on pleasure boats or on fishing boats, and especially to a technique for restraining consumption, omission or degradations of thermionic emission performance filled into the cathode.

A magnetron which is especially used for a radar is mostly operated in a pulse-like manner and an extremely large current density is generally expected for electron flow emitted from a cathode thereof. Due to this fact, a surface of this cathode receives inverse impulse from electrons or ions (impulse caused through ions or once emitted electrons returning back to the cathode) so that thermionic emitting materials such as oxides are consumed and decreased through sputtering, and the magnetron can no more perform accurate operations in case such phenomena repeatedly occur. In case no uniform current density can be obtained owing to lack in uniformity of particle sizes of the thermionic emitting materials, partial decreases in the thermionic emitting materials are caused to thereby shorten a life cycle of the magnetron.

In view of these facts, it has been proposed for a method of covering surfaces of base metals with a porous body or metallic mesh of good conductivity and filling thermionic emitting materials on corresponding portions thereof to thereby achieve uniformity of current density owing to good conductivity, and of controlling the degree of decrease of thermionic emitting materials by further adjusting hole rates of the porous body or fineness of reticulations of the mesh.

There are also known methods which are devised to make thermionic emitting materials uniformly decrease through further achieving uniformity of exposure of the thermionic emitting materials rather than adjusting holes or reticulations.

FIG. 12 is a view showing an arrangement of electrode portions of a conventional magnetron to which this kind of device is made. Numeral 1 denotes a cathode and 2 an anode. In the cathode 1, numeral 11X is a base metal of Ni or the like formed in a cylindrical shape with a plurality of concave grooves 131 being formed at a specified pitch in a peripheral direction of a surface thereof, 12 thermionic emitting materials of oxides of alkali earth metals or the like which are filled into these concave grooves 131, 13 a cathode supporting body (sleeve) which is fixedly attached to inside of the base metal 11X, and 14 a heater which is arranged in the interior of the cathode supporting body 13.

FIG. 13 is a view showing a base metal 11Y of another prior art wherein a plurality of concave grooves 132 are formed at a specified pitch in a direction parallel to an axial direction of a surface of the base metal 11Y and wherein thermionic emitting materials 12 are filled into these grooves.

FIG. 14 is a view showing a base metal 11Z of still another prior art wherein a plurality of concave pits 133 are formed on a surface of the base metal 11Z in a discrete manner through wet etching. Each concave pit 133 is so formed that an area of its bottom surface is larger than that of its aperture.

In these examples as illustrated in FIGS. 12 to 14, the thermionic emitting materials 12 filled into the concave grooves 131, 132 or the concave pits 133 of the base metals 11X, 11Y and 11Z are heated to nearly 800° C. by the heater 14 whereby thermoelectrons are emitted from surfaces thereof which are exposed to the exterior. In case direct-current high voltage is impressed such that the cathode 1 is negative and the anode 2 is positive, and a magnetic field is impressed in vertical directions in the illustrated example of FIG. 12, electrons emitted from the thermionic emitting materials 12 are made to rapidly move (spin) in a peripheral direction in a space formed between the base metal 11X and the anode 2 to thereby generate microwaves.

However, in the case of cathodes of conventional arrangements utilizing base metals 11X, 11Y, 11Z as illustrated in the above FIGS. 12 to 14, while quantification of areas of the thermionic emitting materials 12 which are exposed to the exterior is performed, there are taken no measures for adjusting degrees of receiving inverse impulse from electrons or ions, and degrees of consumption and decrease are not improved. Although areas of bottom surfaces of the concave pits 133 are larger than their aperture areas by approximately several % (generally approximately 5%)in the arrangement of the base metal 11Z shown in FIG. 14, these shapes are formed through wet etching in a subordinate manner, and thus, the life cycle of the cathode is hardly different from those of the examples as illustrated in FIGS. 12 and 13.

Therefore, it is an object of the present invention to solve the above problems, and to provide a cathode for a magnetron which exhibits durability against inverse impulse from electrons or ions and which is of long life.

SUMMARY OF THE INVENTION

A first aspect of the present invention for solving the above problems relates to a cathode for a magnetron having concave/convex portions on a surface of a cylindrical base metal with thermionic emitting materials being fixedly attached to concave portions from among the concave/convex portions, wherein the convex portions of the concave/convex portions are arranged to be inclining.

In a second aspect of the present invention, the convex portions as recited in the first aspect are arranged to be inclining in a range of approximately 25 to 63 degrees in moving directions of electrons with respect to a normal line of the base metal.

In a third aspect of the present invention, areas of bottom surfaces of the concave portion of the concave/convex portions as recited in the first or second aspect are arranged larger than areas of apertures of the concave portion by at least 10%.

In a forth aspect of the present invention, the base metal as recited in the first or second aspect is formed of a material formed by cold drawing or a material formed by cold extrusion, and the concave portions of the concave/convex portions are composed of a plurality of concave grooves extending in a direction parallel to an axial direction of the base metal.

In a fifth aspect of the present invention, the concave portions of the concave/convex portions as recited in the first or second aspect are either formed of a plurality of concave grooves which are formed in a direction parallel to an axial direction of the base metal, a plurality of concave grooves which are formed in a direction intersecting the axial direction, a single concave groove which is formed in a threaded shape in a direction diagonal to the axial direction, or a plurality of concave pits which are discretely formed, wherein a part of spaces between mutually adjoining concave portions or convex portions are partially formed in a successive manner.

DETAILED DESCRIPTION

Embodiment 1

Figure 1:
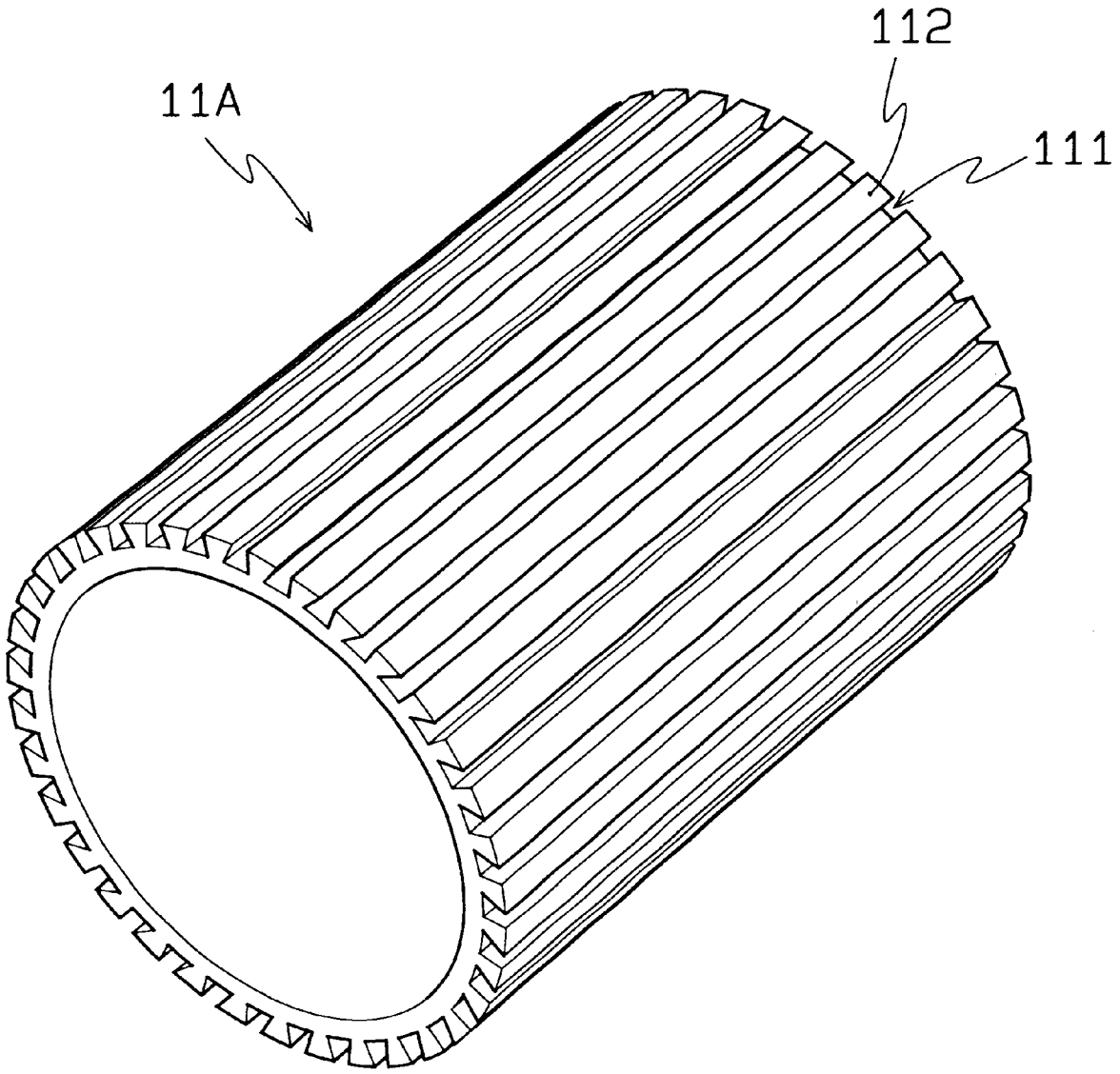
FIG. 1 is a perspective view of a base metal according to a first embodiment of the present invention.
Figure 2:
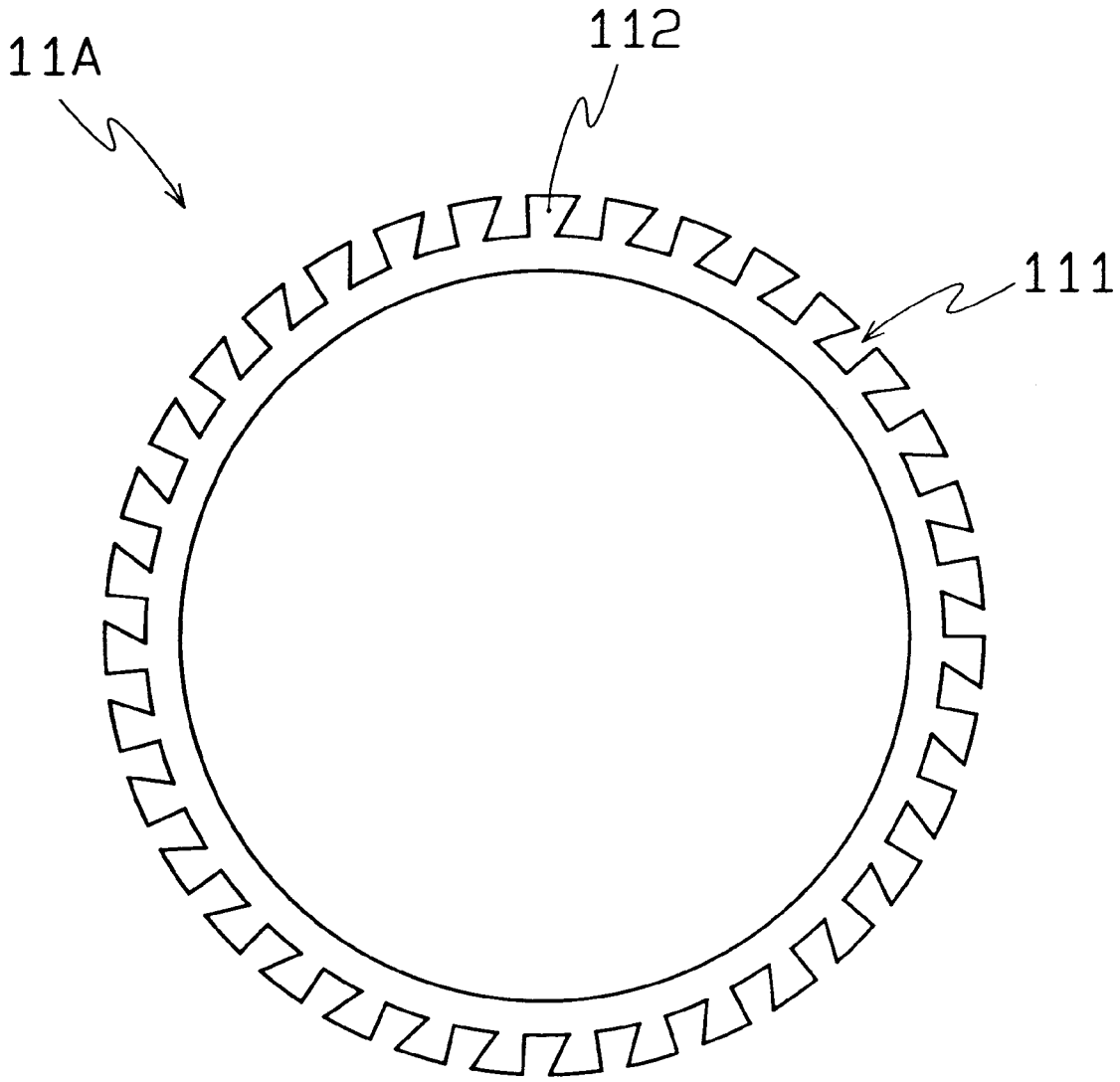
FIG. 2 is a sectional view of the base metal of FIG. 1.
Figure 3:
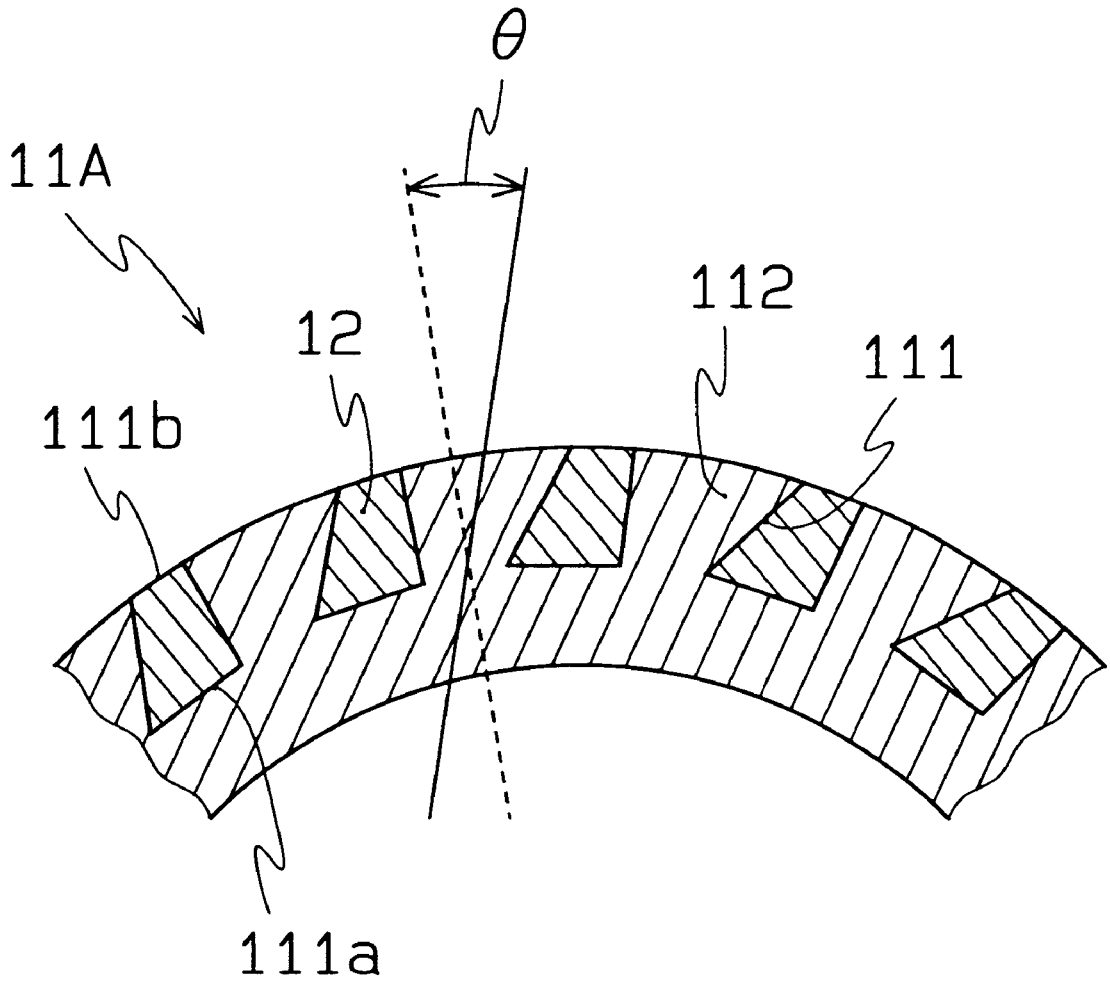
FIG. 3 is a partially enlarged sectional view of the base metal of FIG. 1.
Figure 12:
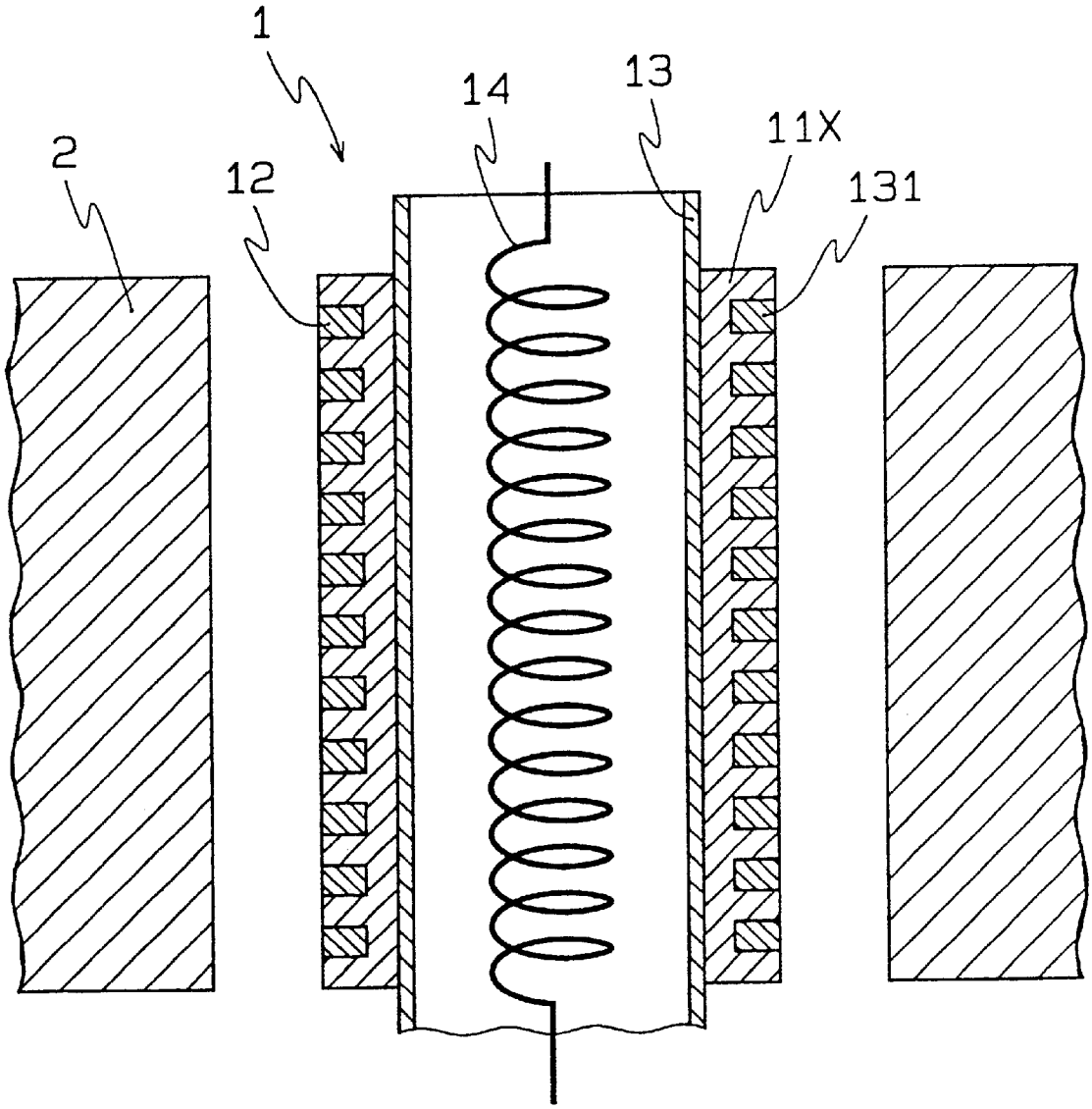
FIG. 12 PRIOR ART
FIG. 12 is a sectional view of electrode portions of a conventional magnetron.
Figure 13:
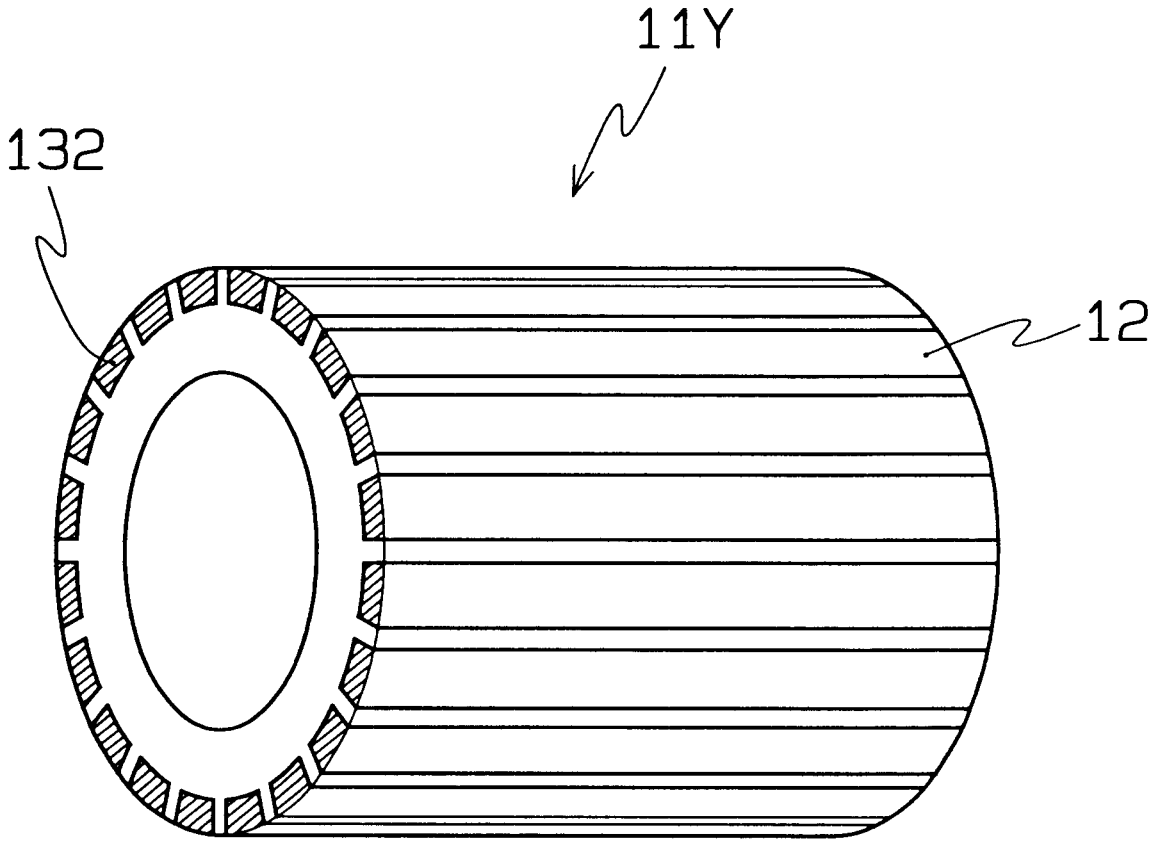
FIG. 13 is a perspective view of a base metal of another prior art.

FIG. 1 is a perspective view showing a base metal 11A according to a first embodiment of the present invention, FIG. 2 a sectional view thereof, and FIG. 3 a partially enlarged view of a section filled with thermionic emitting materials. The base metal 11A is generally formed of a material such as metallic nickel of high purity or metallic nickel containing a minute amount of magnesium. The base metal 11A is so formed that a plurality of concave grooves 111 (which assume a depth of e.g. 0.1 to 0.3 mm) is formed on its surface at a specified pitch (e.g. 0.2 to 0.5 mm) along an axial direction thereof, and thermionic emitting materials 12 are filled into these concave grooves 111. The thermionic emitting materials 12 might be composed of, for instance, mixed carbonate including barium (Ba), strontium (Sr), and calcium (Ca). It should be noted that the. base metal 11A is fixedly attached to a cathode supporting body 13 and is heated by a heater 14, similar to a conventional base metal 11X as illustrated in FIG. 12.

In the illustrated embodiment, areas of bottom surfaces 111*a* of the concave grooves 11A are formed to be larger than areas of apertures 111*b* by not less than 10% (not less than 1.1 times). As illustrated in an enlarged form in FIG. 3, convex streaks 112 which are formed by forming the concave grooves 111 are inclined by an angle θ (approximately 25 to 63 degrees) with respect to a normal line of the base metal 11A (indicated by the broken line). It should be noted that the solid line representing the angle θ is a line connecting a center of an upper surface of the convex streak 112 and a center of a lower portion thereof.

A direction in which the convex streaks 112 are inclined is determined in view of moving directions of electrons or ions such that the thermionic emitting materials 12 are shaded by the convex streaks 112 against the moving directions of inverse impulse of the thermoelectrons.

For forming the concave grooves 111 on the surface of the base metal 11A, it is possible to employ a method for performing lathe machining or electron discharge machining of cylindrical metal used as an initial material; alternatively, the structure of FIG. 1 can be manufactured by overlapping a required number of nickel metallic plates having a thickness of approximately 0.2 mm which have been blanked to assume a sectional shape as shown in FIG. 2 through press working. To make manufacturing thereof simpler, a continuous pipe material having a sectional shape as shown in FIG. 2 might be formed through drawing or extrusion which is then cut to an appropriate length. As for the means for drawing and extrusion, cold forming is preferable in improving machining accuracy and is especially favorable in forming fine concave grooves 111 on the surface of the base metal 11A in case it is used for a small-sized magnetron.

Upon manufacture of the base metal 11A of an arrangement as illustrated in FIG. 1, an oxide cathode can be completed by filling thermionic emitting materials 12 into the concave grooves 111. For filling the thermionic emitting materials 12, any methods such as a coating through spraying, a dip coating, or a coating through dropping might be employed.

When an oxide cathode thus obtained is heated by the heater 14 through flowing of current and by heating the thermionic emitting materials 12 to approximately 800° C. through the base metal 11A, thermoelectrons are emitted from the surface thereof.

Owing to the oscillating mechanism of the magnetron, surfaces of thermionic emitting materials which are exposed from the apertures of the concave grooves of the base metal avoidably receive inverse impulse from thermoelectrons or ions. Thus, a magnetron is conventionally known to exhibit large consumption of thermionic emitting materials and thus to be of shorter life than compared to a diode or the like.

To cope with this drawback, areas of bottom surfaces of the concave grooves 111 are set to be larger than areas of apertures by not less than 10% in the present embodiment, that is, aperture portions are deliberately made narrower than bottom portions, and in addition to this arrangement, convex streaks 112 are inclined by an angles θ with respect to a direction of the normal line of the cylindrical body. In this manner, most of the thermionic emitting materials 12 are covered by inner walls of the concave grooves 111 as to be closed thereby so as to effectively protect the thermionic emitting materials 12 from inverse impulse of electrons or ions. Thus, an amount of evaporation and consumption of thermionic emitting materials 12 can be made smaller than compared to those of the prior art, thereby achieving long life.

As noted above, the thermionic emitting materials are generally obtained by mixing three types of carbonates, that is, Ba, Sr and Ca, wherein rates of thermionic emission are dependent on mixing ratios thereof. In case of utilizing thermionic emitting materials of mixed carbonates including Ba, Sr and Ca, Ba is consumed in the course of utilization (in accordance with time of actuation), so that the ratio of the three carbonates is varied, and the amount of thermionic emission is gradually decreased. The decreasing rate thereof in case of a magnetron is not less than 10% when actuated for 2,000 hours.

In order to compensate this decrease, there might be employed an arrangement in which surface areas of thermionic emitting materials are increased accompanying the decrease in the amount of thermionic emitting materials. This embodiment is so arranged, in view of this phenomenon, that the surface areas of the bottom portions of the thermionic emitting materials 12 are made to be larger than the aperture portions by not less than 10%.

In this manner, there can be continuously obtained an amount of thermionic emission which is close to a specified value since tendencies of decrease in the amount of thermionic emission in the course of actuation (utilization) of magnetrons are coped with through increases in surface areas of the thermionic emitting materials 12 in accordance therewith.

Another effect is achieved by the inclination of the convex streaks 112 by an angle θ to partially protect the thermionic emitting materials 12 from inverse impulse so as to restrict directions of secondary electrons generated through the inverse impulse, whereby radiation levels of higher harmonics, especially of the 2nd harmonics, an be largely restrained than compared to the prior art.

Figure 4:
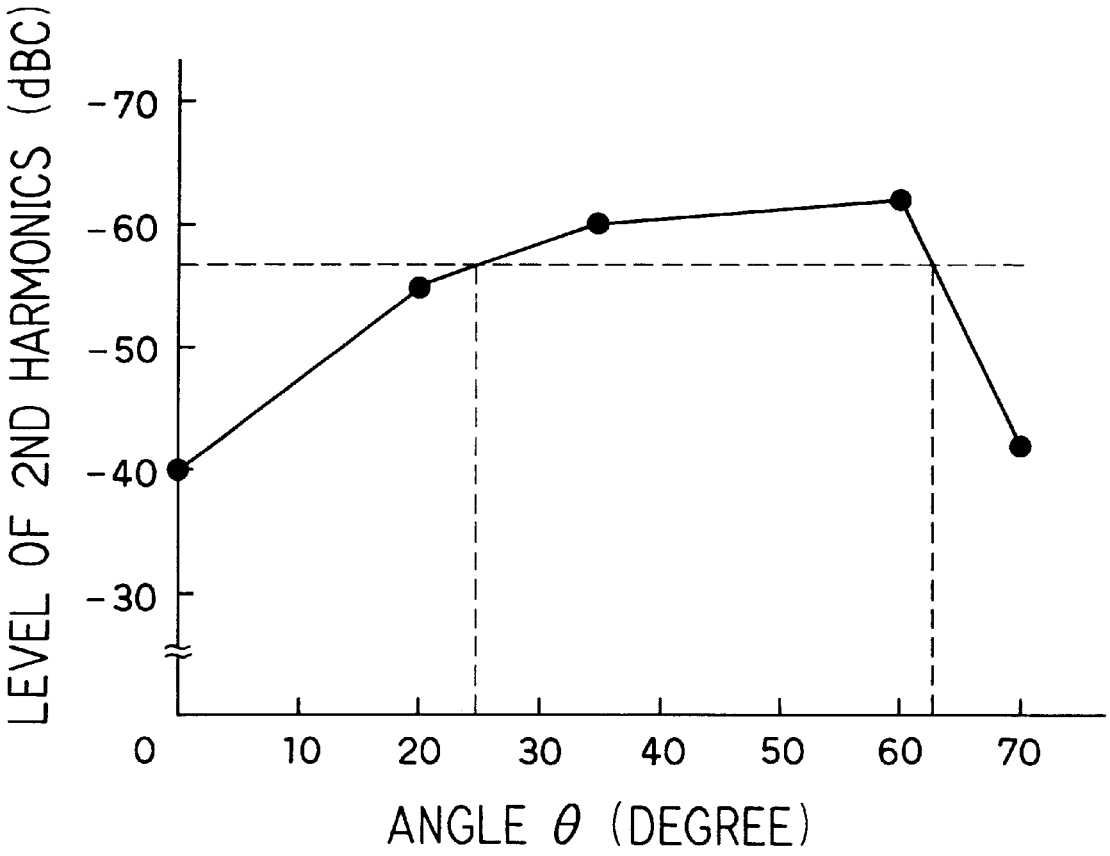
FIG. 4 is a characteristics view of radiation levels of 2nd harmonics with respect to angle θ.

Such effects are shown in FIG. 4. As is obvious from the drawing, in case the angle θ of the convex streaks 112 is in the range of approximately 25 to 63 degrees, the level of 2nd harmonics is in the range of −56 dBC to −65 dBC, and thus presents superior characteristics than compared to a general level of 2nd harmonics of −40 dBC to −45 dBC. Especially in case the level of 2nd harmonics can be restrained to be as close as −60 dBC, jamming of (influences on) other communications which are caused through electric waves of 2nd harmonics irradiated from a radar employing an magnetron can be remarkably improved. It should be noted that in case the angle of the convex streaks 112 exceeds 63 degrees, the thermionic emitting materials 12 are excessively shielded so that it might happen that no thermionic emitting performance sufficient for obtaining output from the magnetron can be obtained.

It is also exhibited another effect of efficiently preventing omission of thermionic emitting materials 12. There has been conventionally happened an accident in which thermionic emitting materials were partially omitted owing to oscillation applied to the cathode or other reasons in case thermionic emitting materials 12 are filled into concave grooves or concave pits and actuated. However, since the concave grooves 111 are of large width at bottom portions and the convex streaks 112 are formed to be inclining, accidents in which thermionic emitting materials 12 are omitted can be effectively prevented.

Embodiment 2

Figure 5:
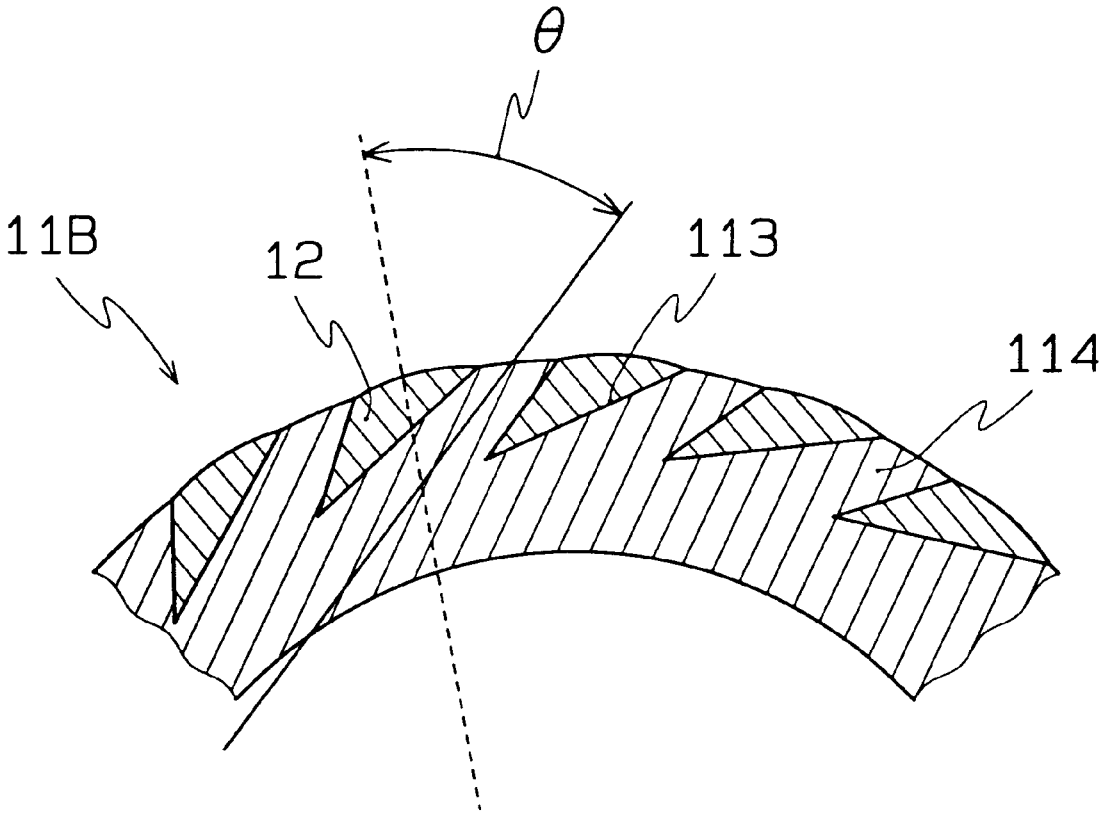
FIG. 5 is a partially enlarged sectional view of a base metal according to a second embodiment.

FIG. 5 is a partial sectional view of a base metal 11B according to a second embodiment of the present invention. In the illustrated embodiment, there are formed concave grooves 113 on a surface of the base metal 11B along an axial direction thereof similarly to FIG. 1, while a sectional shape of each of these concave grooves 113 is wedge-like and the entire shape of the section is formed to be serrate. Convex streaks 114 which are formed by the forming of the concave grooves 113 are also inclined at an angle θ (approximately 25 to 63 degrees) in moving directions of electrons with respect to a normal line of the base metal 11B, so that similar functions and effects as those of the previous case employing the base metal 11A can be obtained.

Embodiment 3

Figure 6:
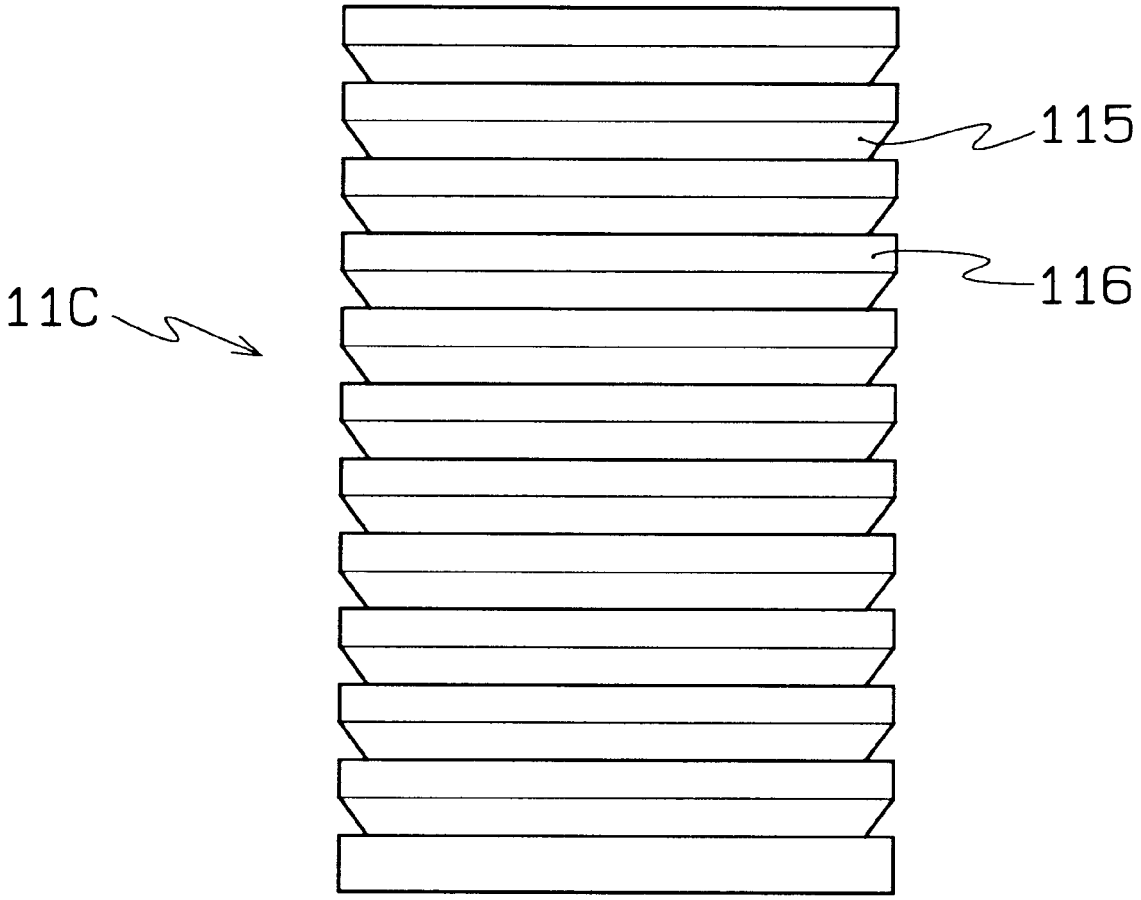
FIG. 6 is a plan view of a base metal according to a third embodiment.
Figure 7:
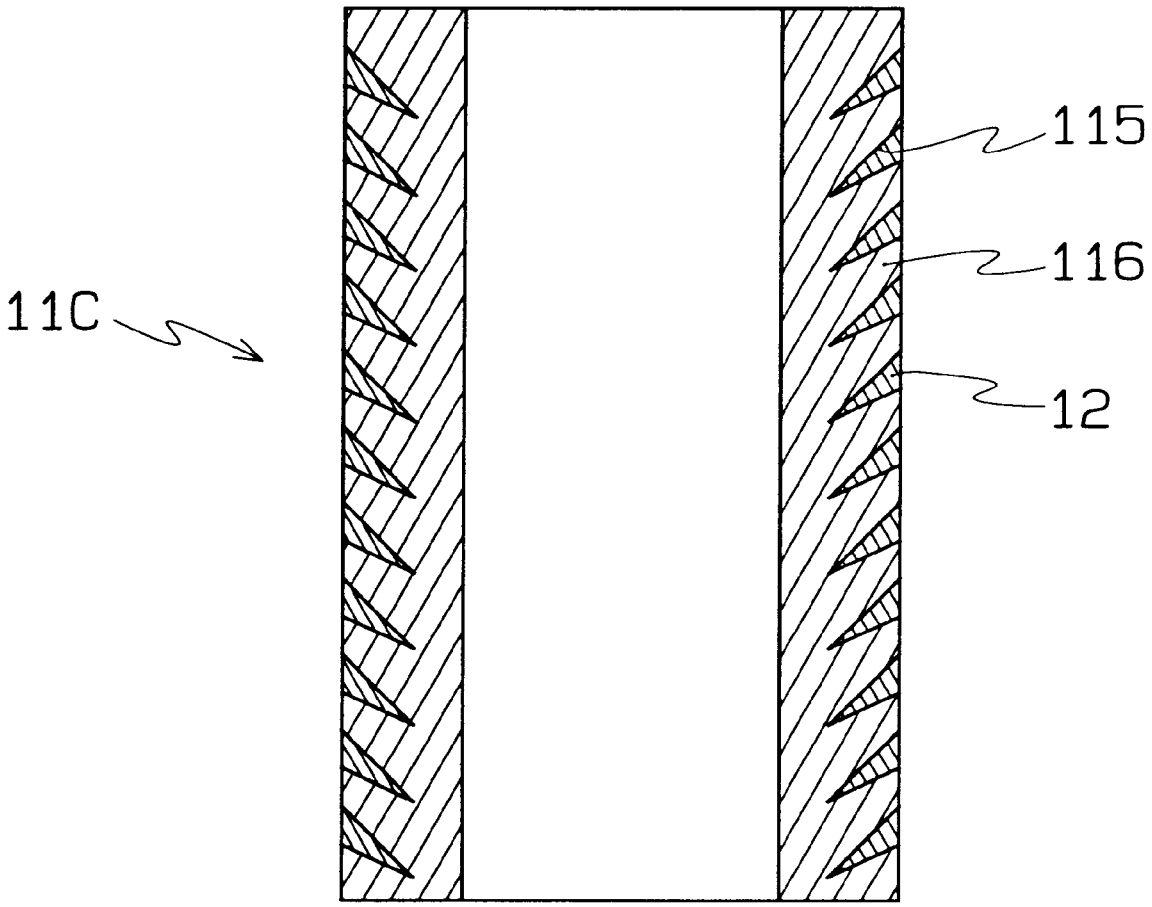
FIG. 7 is a sectional view of the base metal of FIG. 6.

FIG. 6 is a plan view of a base metal 11C according to a third embodiment, and FIG. 7 is a sectional view thereof. In the illustrated embodiment, a plurality of concave grooves 115 are formed at a specified pitch on a surface of the base metal 11C in a peripheral direction thereof, wherein a sectional shape of each of the concave grooves 115 is wedge-like as shown in FIG. 7 and convex streaks 116 which are formed by forming the concave grooves 115 are inclined in an axial direction of the base metal 11C. The inclining direction might be either one in the axial directions and is arbitrary.

Since the concave grooves 115 are formed in the peripheral direction, it is impossible to arrange them to be inclined in moving directions of electrons as in the first and second embodiments. However, since depth portions of the concave grooves 115 are shifted with respect to aperture portions thereof, thermionic emitting materials 12 are partially protected against inverse impulse from the electrons to thereby restrain consumption thereof, and similar functions and effects as those of the first embodiment can be obtained.

In case lathe machining is employed for manufacturing the base metal 11C, cutting might be performed by inclining a bite by a specified angle with respect to a cylindrical metal which is used as an initial material.

Figure 8:
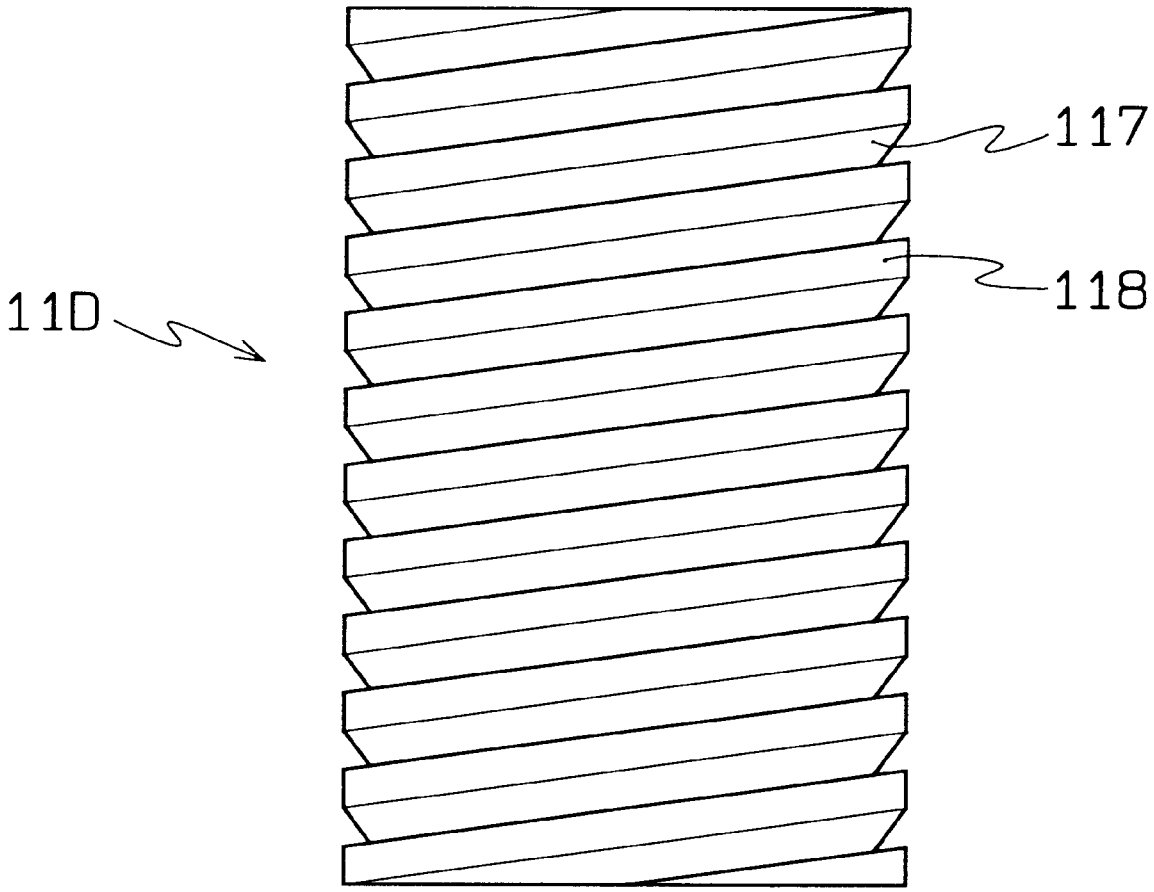
FIG. 8 is a plan view of a base metal according to a modified example of the third embodiment.
Figure 9:
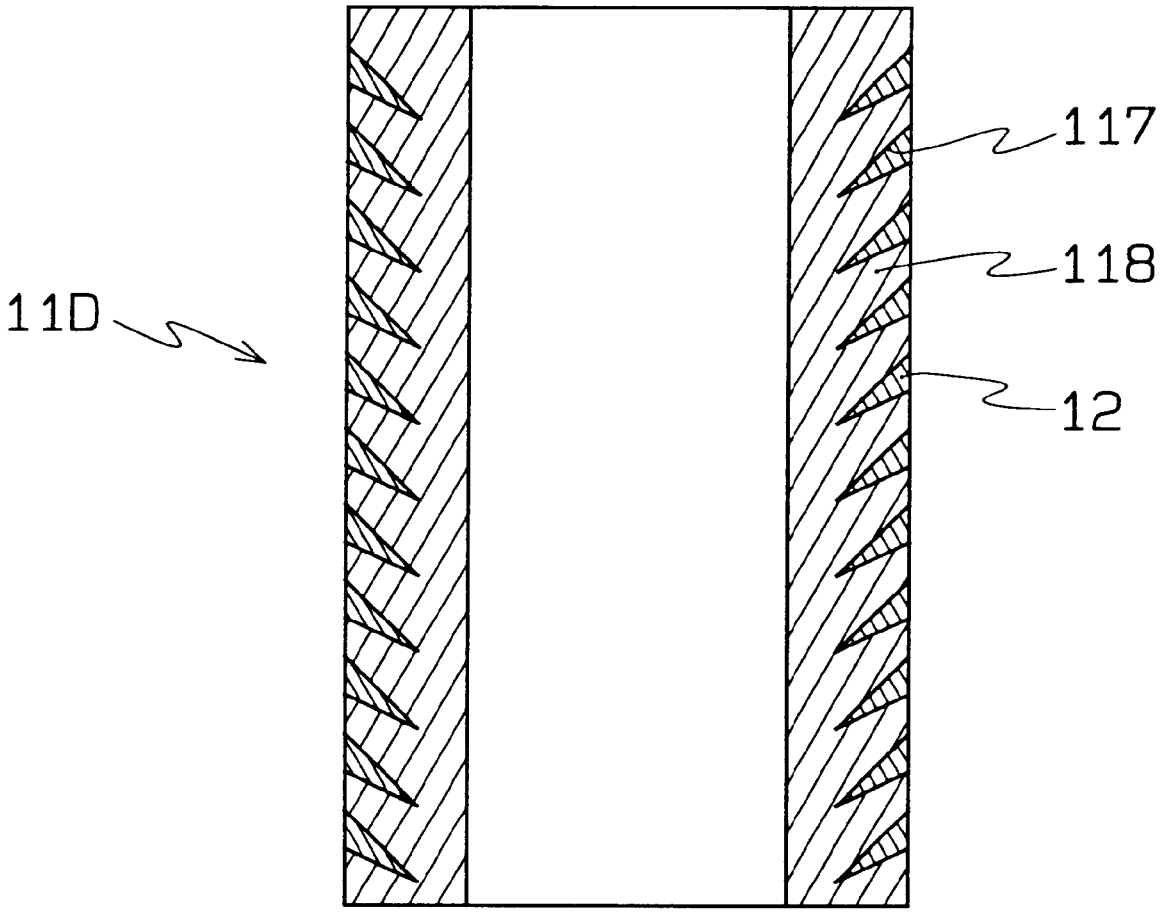
FIG. 9 is a sectional view of the base metal of FIG. 8.

FIG. 8 is a plan view of a base metal 11D of a modified example of the present embodiment, and FIG. 9 a sectional view thereof, wherein a single concave groove 117 is formed on a surface of the base metal 11D in a diagonally succeeding manner, that is, in a threaded manner. The concave groove 117 assumes a shape similar to that shown in FIG. 7. Numeral 118 denotes a single spiral convex streak.

Embodiment 4

Figure 10:
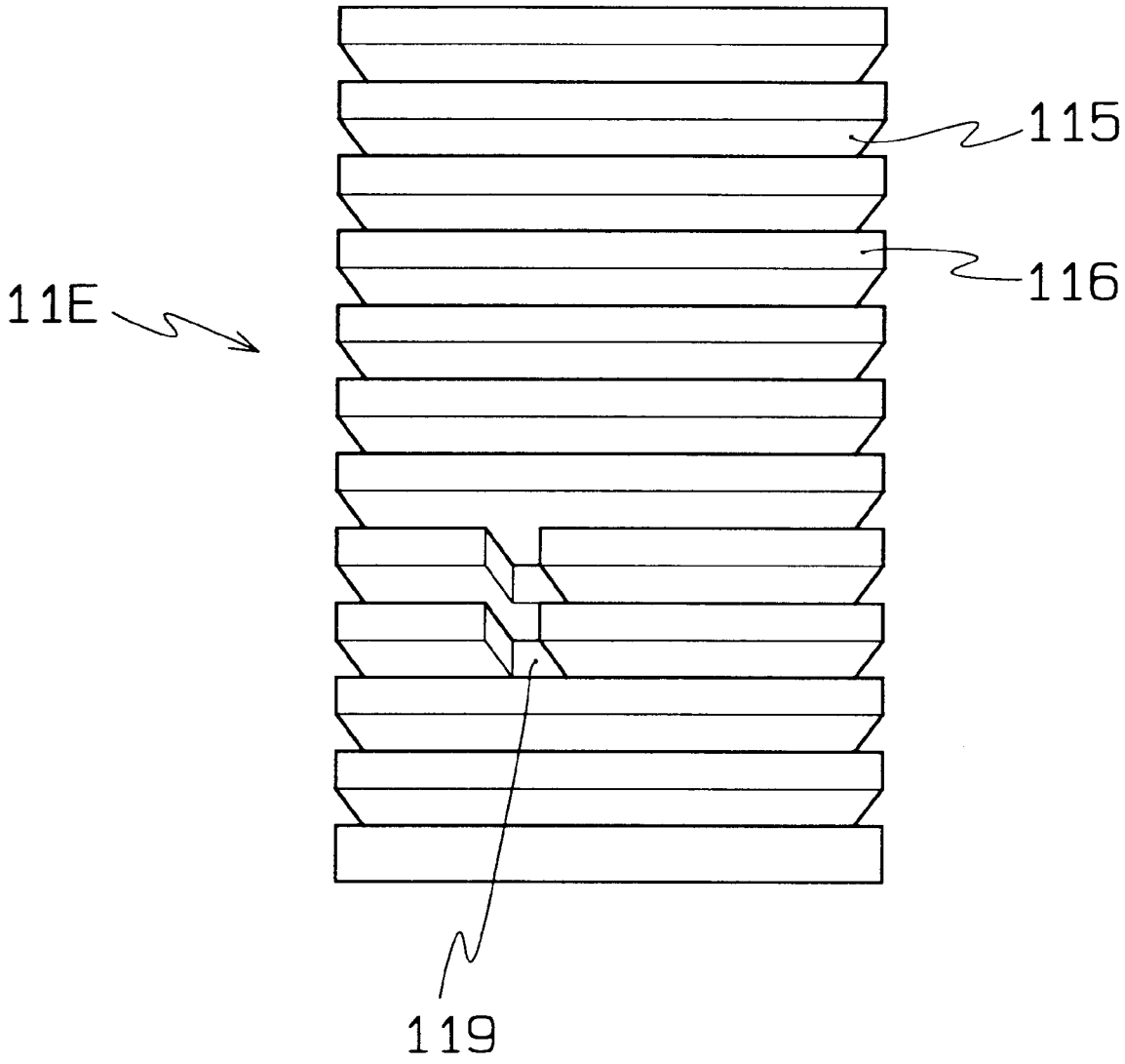
FIG. 10 is a plan view of a base metal according to a fourth embodiment.

FIG. 10 is a plan view of a base. metal 11E according to a fourth embodiment. This embodiment is so arranged that two concave grooves 115 which are adjoining on a part of the base metal 11C of FIG. 6 are connected in a continuous manner through a different concave groove 119 formed to be disposed between the concave grooves 115.

In case concave grooves 115 are formed on a surface of a base metal in a peripheral direction, there might be happened that resonance is generated depending on the lengths and number of concave grooves 115, and in case resonance frequencies are close to oscillating frequencies of the magnetron, actions of the magnetron might be affected to cause unstable actions or spurious radiation.

Therefore, by connecting the concave grooves 115 by the concave groove 119, resonance frequencies thereof can be moved to be frequencies which are by far different from oscillating frequencies of magnetrons, so that unstable actions and unnecessary radiation can be prevented.

Figure 11:
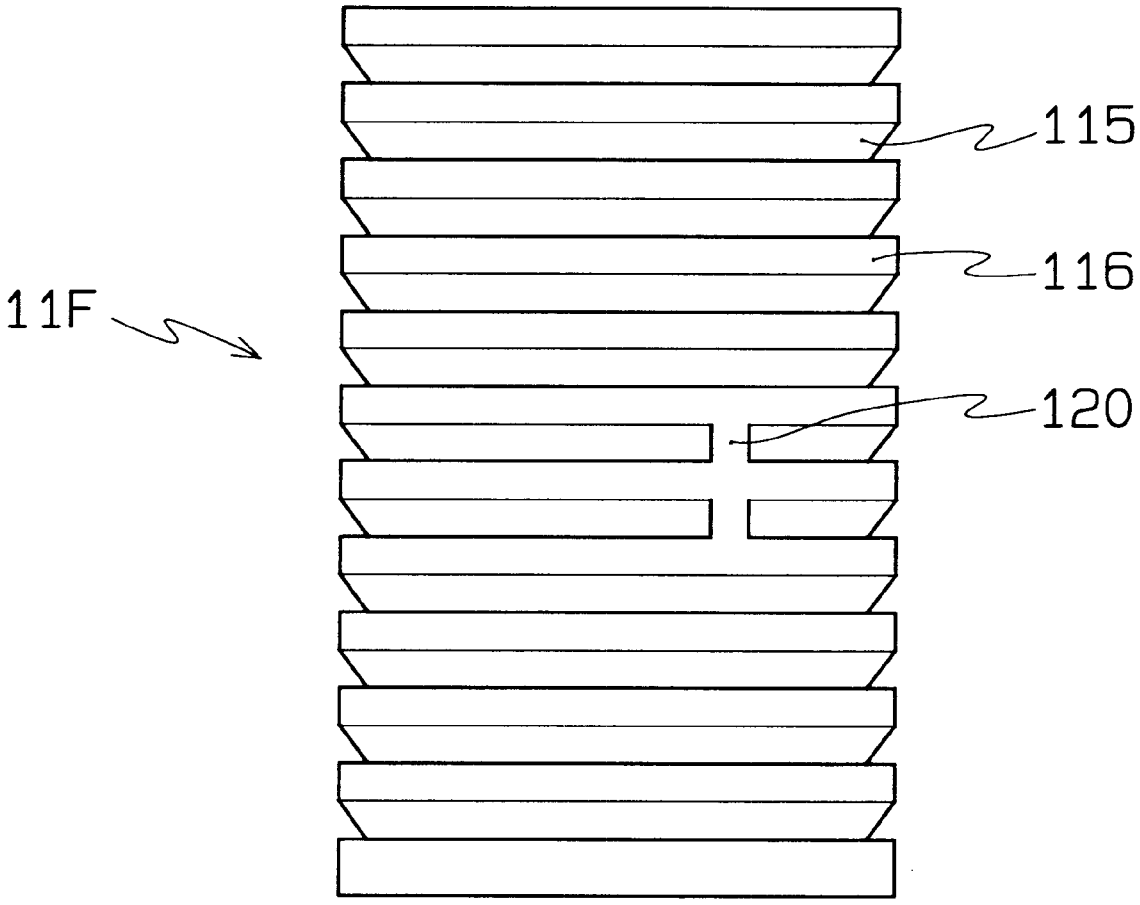
FIG. 11 is a plan view of a base metal according to a modified example of the fourth embodiment.

FIG. 11 is a view showing a base metal 11F according to a modified example of the present embodiment. In this example, a convex portion 120 is formed on a part of adjoining concave grooves 115, that is, three adjoining convex streaks 116 are connected in a continuous manner by the convex portion 120. It is possible to perform shifting of resonance frequencies also with this arrangement.

The above-described concave groove 119 for connecting the concave grooves 115 or convex portion 120 for connecting the convex streaks 116 might be similarly formed for the concave grooves 111 or convex streaks 112 of the base metal 11A of FIG. 1, the concave grooves 113 or convex streaks 114 of the base metal 11B of FIG. 5 or the concave grooves 117 or convex streaks 118 of the base metal 11D of FIG. 8, and the number of portions at which these concave grooves 119 and convex portions 120 are arranged are arbitrary.

Other Embodiments

Figure 14:
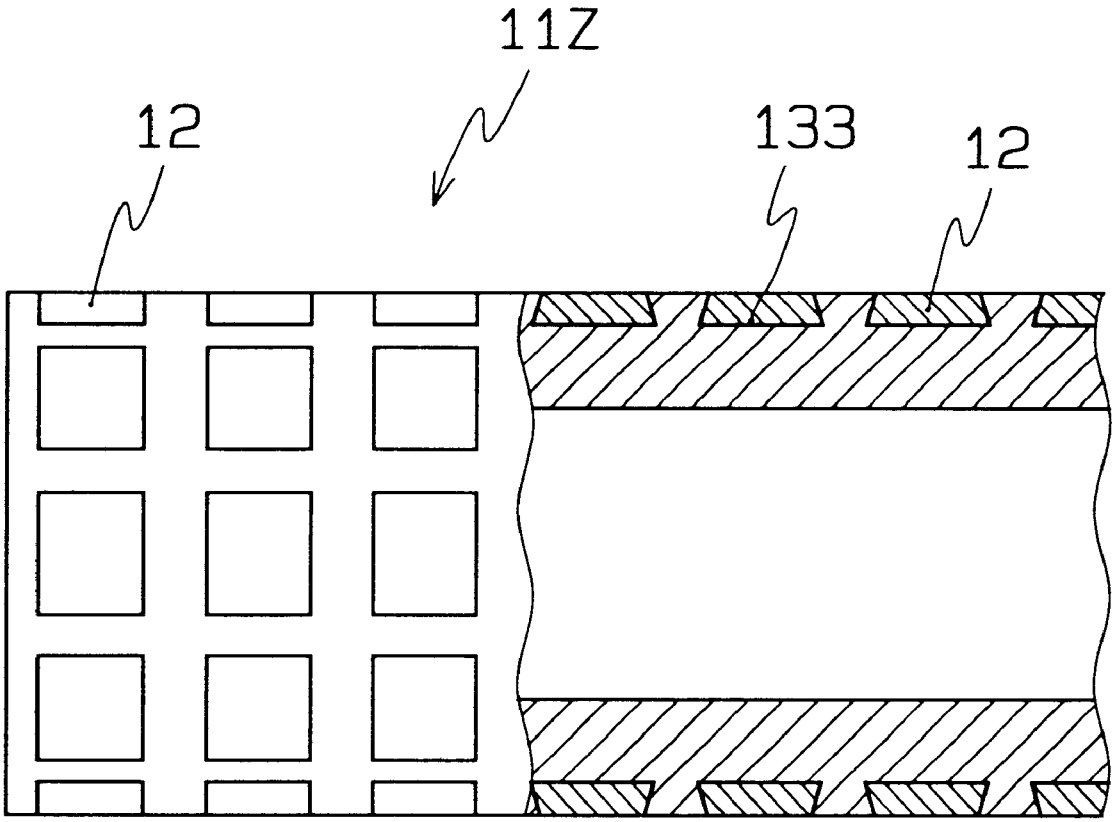
FIG. 14 is a partial sectional view of a base metal of still another prior art.

Although concave portions of the base metals of the above-described embodiments into which the thermionic emitting materials are filled were composed of concave grooves and convex portions formed thereby were convex streaks, the concave portions might alternatively be formed to be discrete as shown in FIG. 14. In this case, it is difficult to form the. concave portions to be assuming wide depth portions or to make the convex portions to be inclined through ordinary machining, but these might be realized by forming a plurality kind of thin plates through pressing nickel metallic plates having a thickness of approximately 0.2 mm which are overlapped thereafter.

As explained so far, it is enabled by the present invention to effectively protect thermionic emitting materials from inverse impulse of electrons or ions and from oscillation to thereby restrain consumption and omission of these thermionic emitting materials and to decrease higher harmonics of radiation. Further, since surface areas are increased in proportion to decreases in thermionic emitting materials, it is enabled to secure a continuously constant amount of thermionic emission to thereby obtain a cathode of long life. Still further, resonance frequencies can be effectively shifted from oscillating frequencies of the magnetron.

What is claimed is:

1. A magnetron cathode comprising:

a cylindrical surface of a base metal, the surface including concave grooves and convex portions disposed between the grooves; and thermionic emitting materials fixedly attached and filled into the grooves;

wherein each of the convex portions is inclined, as a whole, to the surface.

2. The cathode for a magnetron of claim 1, wherein the convex portions are inclined in a range of approximately 25 to 63 degrees in moving directions of electrons with respect to a normal line of the base metal.

3. The cathode for a magnetron of any one of claims 1 to 2, wherein areas of bottom surfaces of the grooves are larger than areas of apertures of the grooves by at least 10%.

4. The cathode for a magnetron of any one of claims 1 to 2, wherein the base metal comprises a material formed by cold drawing or a material formed by cold extrusion, and the grooves extend in a direction parallel to an axial direction of the base metal.

5. The cathode for a magnetron of claim 3, wherein the base metal comprises a material formed by cold drawing or a material formed by cold extrusion, and the grooves extend in a direction parallel to an axial direction of the base metal.

6. The cathode for a magnetron of any one of claims 1 to 2, wherein the grooves comprise a plurality of concave grooves which are formed in a direction parallel to an axial direction of the base metal, a plurality of concave grooves which are formed in a direction intersecting the axial direction, a single concave groove which is formed in a threaded shape in a direction diagonal to the axial direction, or a plurality of concave pits which are discretely formed, wherein a part of spaces between mutually adjoining concave portions or convex portions are partially formed.

7. The cathode for a magnetron of claim 3, wherein the grooves comprise a plurality of concave grooves which are formed in a direction parallel to an axial direction of the base metal, a plurality of concave grooves which are formed in a direction intersecting the axial direction, a single concave groove which is formed in a threaded shape in a direction diagonal to the axial direction, or a plurality of concave pits which are discretely formed, wherein a part of spaces between mutually adjoining concave portions or convex portions are partially formed.

8. The cathode for a magnetron of claim 4, wherein the grooves comprise a plurality of concave grooves which are formed in a direction parallel to an axial direction of the base metal, a plurality of concave grooves which are formed in a direction intersecting the axial direction, a single concave groove which is formed in a threaded shape in a direction diagonal to the axial direction, or a plurality of concave pits which are discretely formed, wherein a part of spaces between mutually adjoining concave portions or convex portions are partially formed.

9. The cathode for a magnetron of claim 1, wherein an angular inclination of the convex portion is defined by a line joining a lower midpoint of lower corners of adjoining grooves to an upper midpoint of upper corners of the convex portion, and wherein the angular inclination of the line to the surface is between approximately 25 degrees and approximately 63 degrees.

* * * * *